US005706741A

United States Patent [19]

Thorp et al.

[11] Patent Number: 5,706,741

[45] Date of Patent: Jan. 13, 1998

[54] UPRIGHT FREE-STANDING SHELF UNIT

[75] Inventors: Clarkson S. Thorp, Wayland; Paul A. Glashouwer, Byron Center; Brian D. T. Alexander, Fennville, all of Mich.

[73] Assignee: Haworth, Inc., Holland, Mich.

[21] Appl. No.: 649,033

[22] Filed: May 16, 1996

Related U.S. Application Data

[63] Continuation-in-part of Ser. No. 39,979, Jun. 7, 1995, abandoned.

[51] Int. Cl.[6] ..... A47B 3/00

[52] U.S. Cl. ..... 108/193; 108/153; 211/208; 211/187

[58] Field of Search ..... 108/192, 190, 108/193, 180, 186, 153, 106, 144; 211/190, 191, 208, 187

[56] References Cited

U.S. PATENT DOCUMENTS

| | | | |
|---|---|---|---|
| 387,267 | 8/1888 | Talbot | 108/190 |
| 916,785 | 3/1909 | Rowell | 108/106 |
| 1,169,720 | 1/1916 | Harris | 108/106 |
| 1,431,823 | 10/1922 | Leconte | 108/190 |
| 3,783,801 | 1/1974 | Engman | 108/190 X |
| 4,501,512 | 2/1985 | Hiltz | 108/153 X |
| 4,760,800 | 8/1988 | Hanson | 108/190 |
| 5,036,778 | 8/1991 | Briosi | 108/187 X |

FOREIGN PATENT DOCUMENTS

| | | | |
|---|---|---|---|
| 251622 | 10/1975 | Germany | 108/190 |
| 923008 | 4/1963 | United Kingdom | 108/190 |

OTHER PUBLICATIONS

*Interiors & Sources*, May 1995, (1 page).
*Today's Facility Manager*, "Product of the Month", May 1995 (1 page).
*Architectural Record*, "Teamwork Kit–of–Parts", May 1995 (1 page).
*Interiors*, "Products Introduction", May 1995 (2 pages).
*Facilities Design & Management*, "Hotline", May 1995 (2 pages).
*Contract Design*, May 1995 (1 page).
*Contract Design*, "The Future Arrives–in 1995?", May 1995 (1 page).

*Primary Examiner*—Jose V. Chen
*Attorney, Agent, or Firm*—Flynn, Thiel, Boutell & Tanis, P.C.

[57] ABSTRACT

A shelf unit which exhibits a high degree of flexibility with respect to assembling and reconfiguring the shelf unit for any of a wide variety of uses. The shelf unit includes left and right ladder-like vertical leg structures which have cross members that define a plurality of vertically spaced mounting locations upon which an interior shelf is selectively mountable. Vertical uprights of the leg structures being readily connectable to a variety of components so as to permit alteration of the base shelf unit itself.

12 Claims, 9 Drawing Sheets

UPRIGHT FREE-STANDING SHELF UNIT

CROSS-REFERENCE TO RELATED APPLICATION

This is a continuation-in-part of U.S. Design Patent application Ser. No. 29/039 979, filed Jun. 7, 1995, now abandoned the disclosure of which is incorporated herein by reference in its entirety.

FIELD OF THE INVENTION

This invention relates to a shelf unit and more particularly, to an upright free-standing shelf unit having laterally spaced ladder-like leg structures which are readily reconfigurable.

BACKGROUND OF THE INVENTION

Frequently, businesses and office areas are divided into a number of workstations which typically include work desks, storage cabinet and other furniture components. While wall panels are frequently used to construct workstations, workstations also are being formed by arrangements of readily movable components such as transportable tables, divider screens, and shelf units which provide more flexibility in office areas. Due to the varying needs of a user, however, the specific construction of the furniture components and in particular, with respect to the invention hereof, of shelf units, may vary. These needs may vary not only between users but over time such that one configuration for example for a shelf unit might be satisfactory at one time but require modification at a later date. It is desirable therefore to provide a shelf unit which exhibits a high degree of flexibility with respect to assembly and reconfiguring the shelf unit for any of a wide variety of uses.

Conventional shelf units, however, while including the necessary components, require complex assembly procedures and thus, are not readily reconfigurable. Similarly, while knockdown furniture is known which is unfoldable into one configuration for use while being folded into a compact configuration for storage is known, such knockdown furniture typically provides only one arrangement which is not readily changeable.

It is desirable therefore to provide a shelf unit which is readily reconfigurable so as to not only construct a wide variety of embodiments of the shelf unit but also readily permit reconfiguration of each shelf unit to add or delete features in structure as necessary. It is further desirable that such a shelf unit include a interior shelf which is readily adjustable to multiple heights or levels as necessary.

This invention generally relates to a shelf unit which includes laterally spaced leg structures having a ladder-like arrangement of vertically spaced cross members which define a plurality of mounting locations or levels in which an interior shelf may be mounted. Additionally, the leg structures include vertical uprights which have threaded bores at the upper and lower ends thereof to facilitate ready connection and disconnection of top and bottom panels. Connection is effected by clamping the top and bottom panels directly between the respective ends of the uprights by either a conventional fastener or a component such as a leg or caster assembly which includes a threaded shank such that the panel is clamped between the caster assembly and the upright.

The shelf unit is readily reconfigurable so as to include a secondary top panel spaced vertically from the primary top panel or to provide further height to the shelf unit, a second stack-on shelf unit can be attached to the upper end of the base shelf unit. Connection is provided by connector assemblies which incorporate threaded inserts which function to clamp the top and bottom panels to the uprights and also provide a mounting location for a tubular spacer which extends therebetween. The tubular spacer connects at its opposite ends to the corresponding connector inserts on the base shelf unit and the stack-on shelf unit so as to effectively join the upper and lower shelf units one with the other.

Other objects and purposes of the invention will be apparent to persons familiar with structures of this general type upon reading the following specification and inspecting the accompanying drawings.

Figure 1:
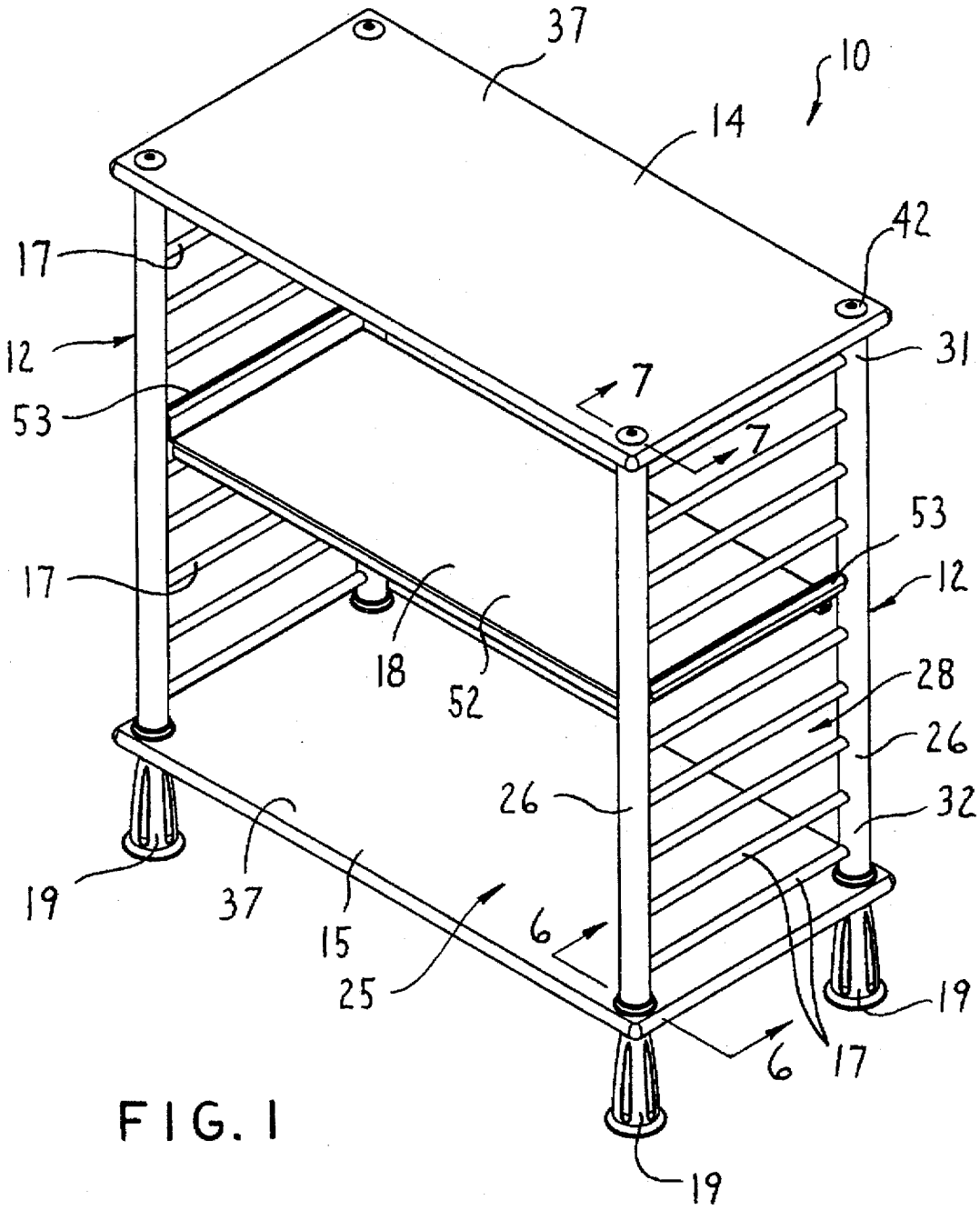
FIG. 1 is a perspective view of a first embodiment of a shelf unit of the invention.
Figure 3:
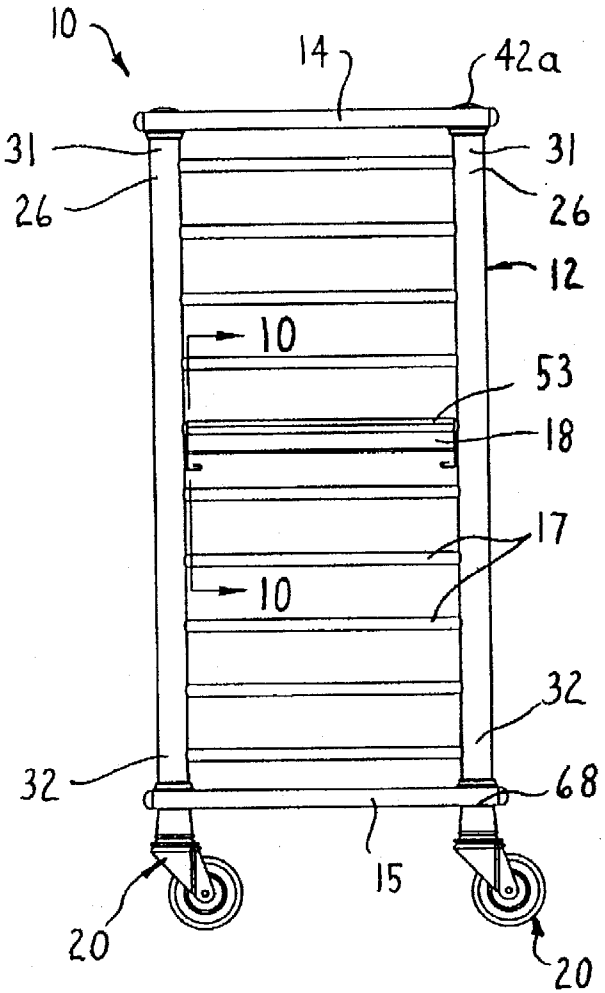
FIG. 3 is a left side elevational view of the second embodiment of FIG. 2.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a readily reconfigurable shelf unit 10 having left and right ladder-like vertical leg structures 12 and horizontal top and bottom panels 14 and 15 extending therebetween.

Figure 2:
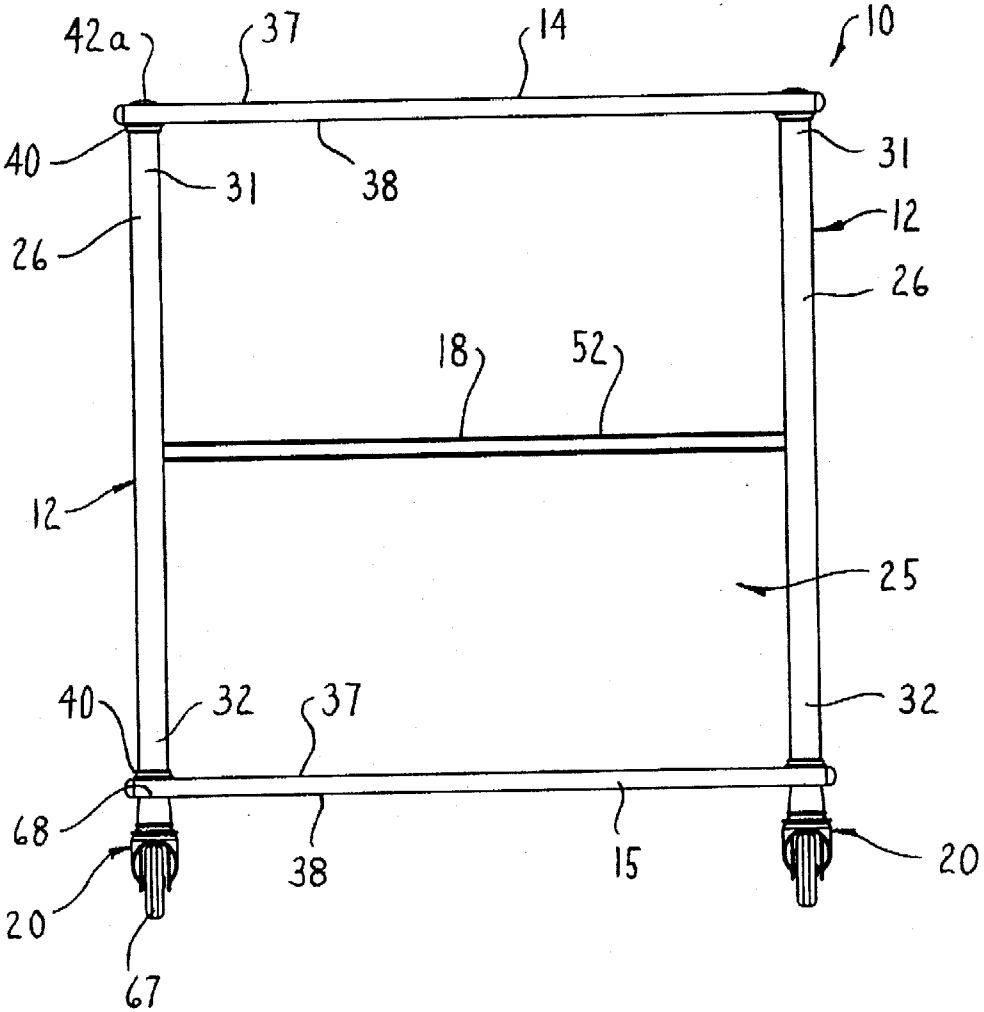
FIG. 2 is a front elevational view of a second embodiment of the invention having fixed support legs.
Figure 4:
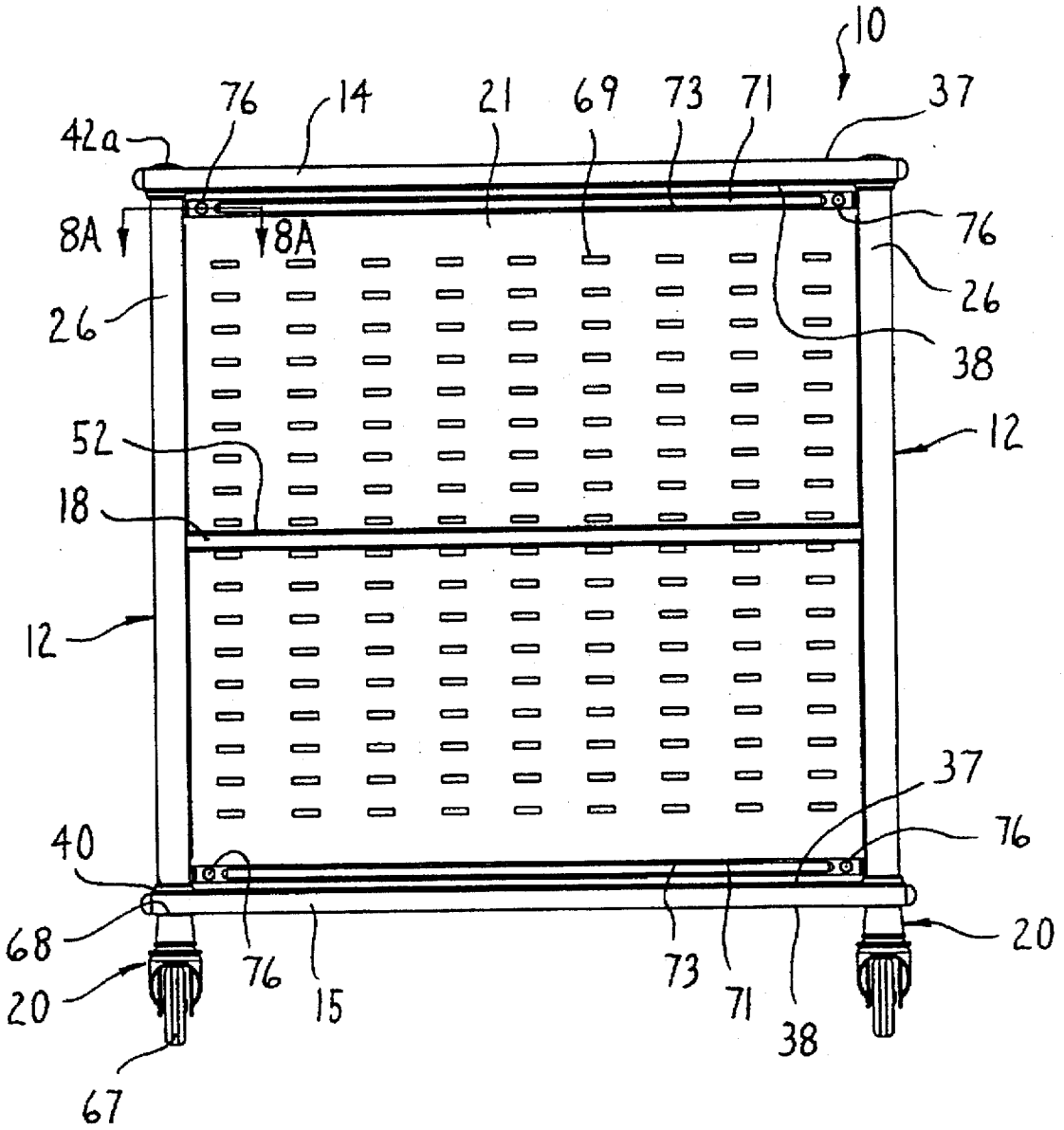
FIG. 4 is a front elevational view illustrating a third embodiment of the shelf unit illustrating the shelf unit of FIG. 2 with a perforated rear panel thereon.
Figure 11:
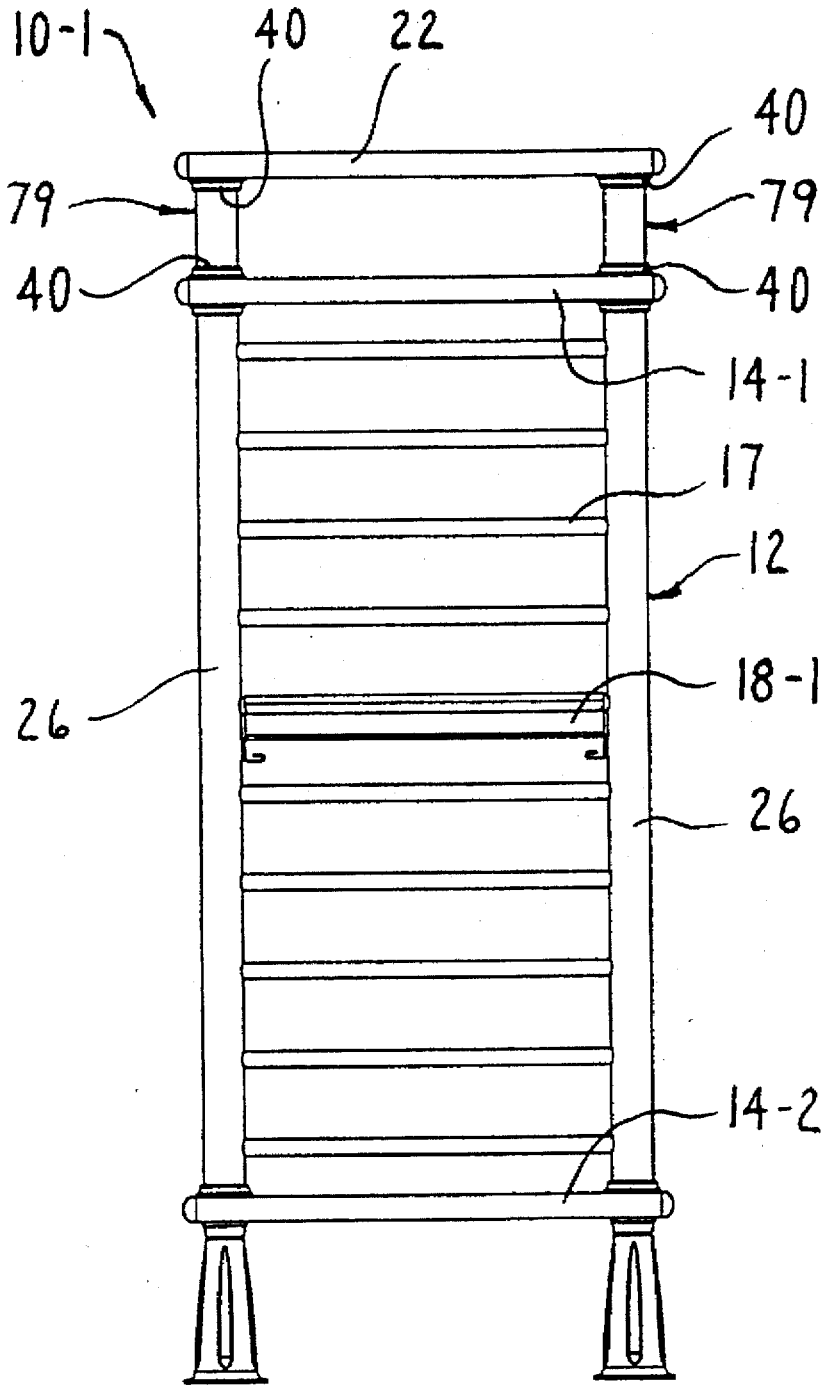
FIG. 11 is a side elevational view of a fourth embodiment of the shelf unit having an upwardly spaced secondary shelf top.

Generally, the shelf unit 10 exhibits a high degree of flexibility with respect to assembling and reconfiguring the shelf unit 10 for any of a wide variety of uses. To provide such flexibility, the leg structures 12 are substantially identical and include a ladder-like arrangement of vertically spaced cross members 17. Thus, in use, the cross members 17 define a plurality of vertically spaced mounting locations upon which an interior shelf 18 is mountable which thereby allows positioning of the shelf unit 18 at any selected level. These leg structures 12, however, provide even further flexibility in that they are readily connectable to a variety of components such as fixed support legs 19 (FIG. 1), caster assemblies 20 (FIG. 2), a perforated panel 21 (FIG. 4) and other features and still further, permit alteration of the base shelf unit 10 itself by the addition of a secondary top panel 22 (FIG. 11) or a stack-on shelf unit 10' (FIG. 15) which defines a vertically enlarged shelf structure. All of these configurations can be accomplished without altering the basic construction of the leg structures 12.

More particularly, referring to FIGS. 1–5, the three embodiments illustrated therein all include the same basic shelf unit configuration of a pair of left and right leg structures 12 which are disposed in a laterally spaced relation so as to define an open interior 25 therebetween, and laterally extending top and bottom panels 14 and 15 which are fixedly connected at their opposite ends to the leg structures 12 and define the respective top and bottom boundaries of the interior 25. The leg structures 12 each comprise a pair of hollow tubular uprights 26 which extend vertically and are fixed in a parallel relation by the cross members 17. The opposite ends of the cross members 17 are inserted in corresponding circular apertures 27 (FIGS. 6 and 7) formed through the tubular walls of the uprights 26 and are then fixed thereto, preferably by welding or the like. Thus, a generally rectangular and horizontal space or opening 28 is formed between each mutually adjacent pair of cross members 17.

To connect the leg structures 12 to the top and bottom panels 14 and 15, the upper end 31 (FIG. 7) and the lower end 32 (FIG. 6) of each upright 26 includes an annular metal insert 33 fixed in place in the hollow interior thereof, preferably by welding. Each insert 33 includes a threaded bore 34 which is aligned coaxially with a longitudinal axis 36 of the upright 26 and extends completely through the insert 33 so as to open into the hollow interior of the upright 26. It should be understood that the ladder-like leg structure 12 is substantially identical for all of the embodiments of FIGS. 1–17 although the height and width of the leg structures 12 are changeable as desired.

Figure 7:
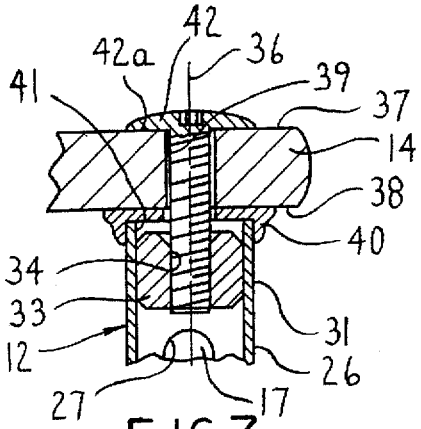
FIG. 7 is an enlarged partial sectional view illustrating a shelf top connection of the first, second and third embodiments of FIGS. 1–5.

Similarly, the top and bottom panels 14 and 15 also are formed identical to each other in FIGS. 1–5 which minimizes the number of different parts required for the shelf unit 10. Referring to FIGS. 1, 5, 6 and 7, the top and bottom panels 14 and 15 are rectangular planar panels preferably formed of wood which define upward and downward facing surfaces 37 and 38. Each of top and bottom panels 14 and 15 includes vertical bores 39 at the four corners thereof which are located so as to be aligned in registry with the respective bores 34 formed in the inserts 33 when seated on the uprights 26 (FIGS. 6 and 7).

Prior to seating the top and bottom panels 14 and 15 on the uprights 26, an annular collar 40 is seated on the opposite ends of the uprights 26 so as to provide a bearing portion between the end of the upright 26 and the opposing panel surface 37 or 38. The collar 40 thereby defines a hollow seat 41 in which the end of the respective upright 26 is inserted, which collar 40 then abuts against one of the opposing upward or downward facing panel surfaces 37 or 38 to distribute vertical loads over a wider surface area.

With respect to the top panel connection (FIGS. 1 and 7), a threaded fastener 42 (i.e., a bolt) is thereafter inserted from above through the respective bore 39 and then threaded into engagement with the threaded bore 34 of the insert 33. The top panel 14 is thus clamped between the left and right leg structures 12 and the fastener head 42*a*.

With respect to the bottom panel connection (FIGS. 1 and 6), an upwardly extending threaded shank 43 of the fixed foot 19 is threaded into engagement with the insert 33 at the lower end 32 of the upright 26. To clamp the bottom panel 15 between the foot 19 and the upright 26, the shank 43 includes a horizontal pin 44 extending therethrough which projects radially from diametrically opposite sides of the shank 43. The pin 44 engages corresponding downwardly opening notches 46 formed in the lower surface of a tube-like insert 47 and presses the insert 47 upwardly toward the bottom panel surface 38 and thereby clamp the bottom panel 15 therebetween.

The foot 19 may be height-adjustable and includes a cone-shaped support housing 48 which slidably receives the insert 47 within an upward opening chamber 49 thereof. The housing 48 is formed with a threaded bore 51 at the bottom of the chamber 49 which threadedly engages the shank 43 and is rotatable to effect vertical movement of the housing 48. The housing 48 which is supported on a floor is thereby movable between an uppermost position illustrated in FIG. 6 in solid lines and a lowered position illustrated in solid lines. Additionally, the enlarged footprint of the housing 48 distribute loads over a larger area of the floor to further ease movement.

With the above-described upper and lower connections (FIGS. 6 and 7 respectively), the leg structures 12 are thereby fixed together with the upper and lower panels 14 and 15 to form the shelf unit 10. Besides the upward facing surfaces 37 for supporting workstation equipment, the shelf unit 10 also includes the interior shelf 18, the opposite ends of which are mountable to any lateral pair of cross members 17. Thus, an interior upward facing surface 52 defined by the interior shelf 18 can be set at a selected level or height within the interior 25.

Figure 5:
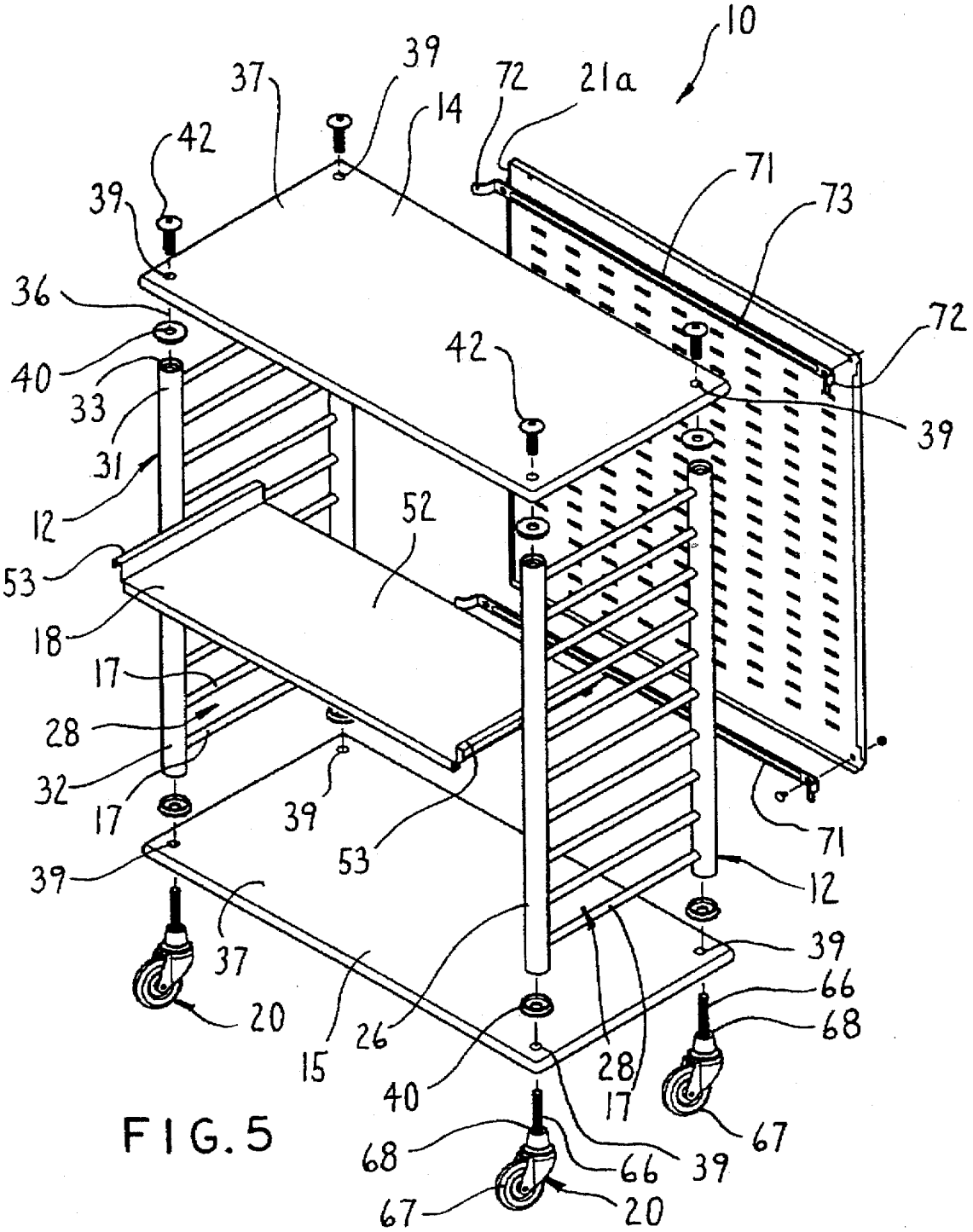
FIG. 5 is an exploded perspective view of the shelf unit of FIG. 4.
Figure 6:
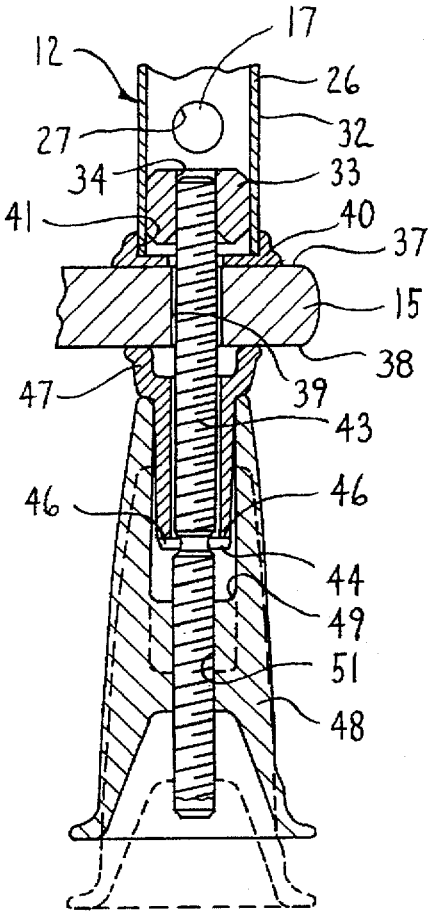
FIG. 6 is an enlarged partial sectional view of the fixed support leg connection of FIG. 1.
Figure 10:
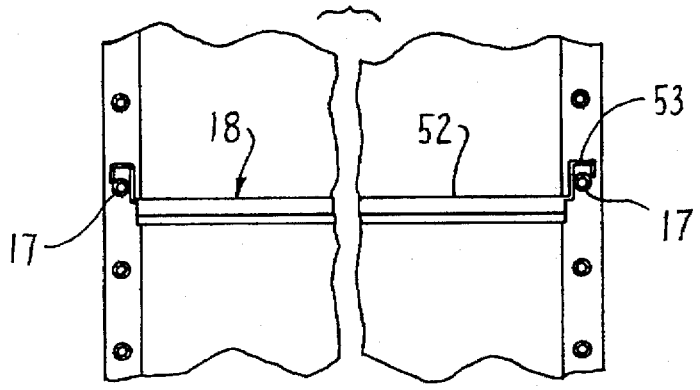
FIG. 10 is a broken front sectional view of a second embodiment of an interior shelf.

Referring to FIGS. 1, 5 and 10, the interior shelf 18 is an elongate metal pan which extends horizontally and at the opposite ends thereof, includes a downward opening channel 53 which extends between the front and rear of the interior shelf 18 and is formed integrally therewith. The channel 53 is adapted to be positioned in the space 28 above a selected cross member 17 and then seated thereon.

Alternatively, an interior shelf 18' (FIG. 9) may be formed as an assembly which includes a rectangular wood panel 54 extending laterally between the cross members 17, a support bracket 56 and a lock bracket 57. The support bracket 56 includes a horizontal channel 58 which seats on a respective cross member 17, and a horizontal leg 59 upon which the wood panel 54 rests. Additionally, the lock bracket 57 includes a lower horizontal leg 60 which abuts upwardly against the support bracket 56 which are both locked together with the wood panel 54 by fasteners 62. The lock bracket 57 also extends upwardly toward the cross member 17 and includes an upper horizontal leg 63 which abuts against the bottom of the cross member 17 when fastened together.

With the above basic arrangement, the shelf unit 10 may be readily reconfigured as desired. For example, the fixed leg 19 (FIG. 1) can be readily replaced with the caster assembly 20 (FIGS. 2–5) to provide rolling and supportive engagement with the floor. The fixed leg 19 can be easily removed by unthreading the shank 43 from the upright 26. The caster assembly 20 which includes a threaded shank 66 (FIG. 5) extending upwardly from a wheel 67 is attached to the shelf unit 10 by threading the shank 66 upwardly into the insert 33 until the bottom panel 15 is clamped between the collar 40 and an upward facing bearing surface 68 of the caster assembly 20.

Still further, in another embodiment illustrated in FIGS. 4, 5, 8 and 8A, the perforated panel 21 is readily mountable to the shelf unit 10 and more particularly, to the rearward uprights 26 of the left and right leg structures 12. The perforated panel 21 not only encloses the back of the shelf unit 10 but further includes a plurality of vertically and horizontally spaced rows of rectangular apertures 69 which are usable to hang office accessories, for example, a cable storage bag. The perforated panel 21 also includes flanges **21*a* which angle forwardly and inwardly at a 45 degree angle from the surfaces of the panel 21. The flanges 21*a* abut against a periphery of the uprights 15 so that the back surface 21*b* of the panel 21*a* aligns with a tangent of the upright 15**.

Figure 8A:
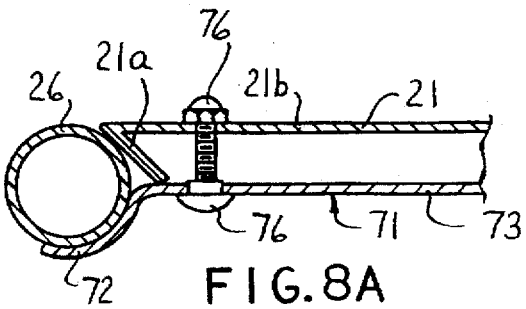
FIG. 8A is an assembled top view of the connection shown in FIG. 8.
Figure 8:
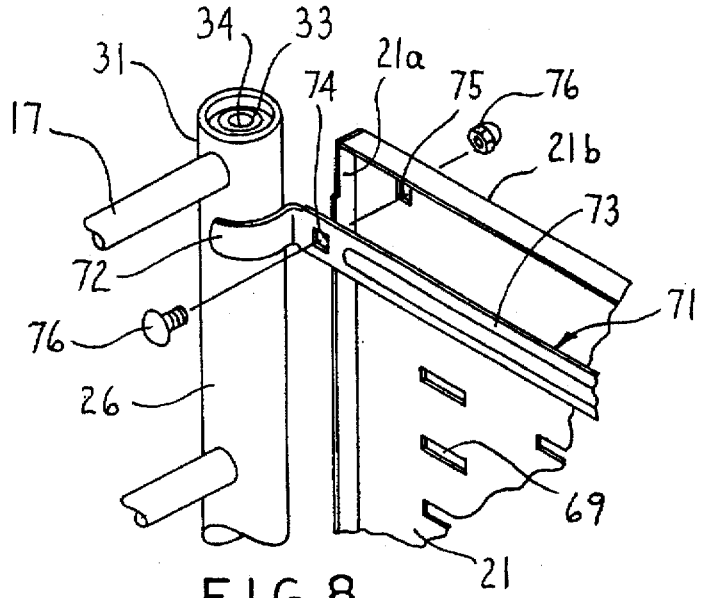
FIG. 8 is an enlarged partial perspective view of a perforated panel connection of the shelf unit of FIG. 5.
Figure 9:
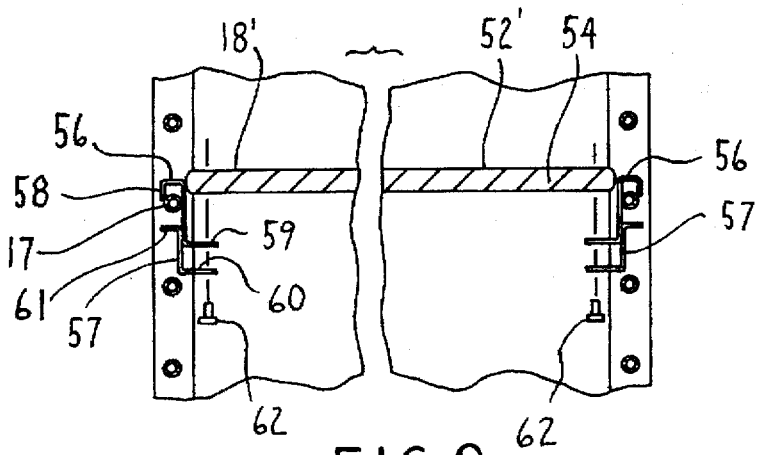
FIG. 9 is a broken front sectional view of a first embodiment of an interior shelf assembly.

To mount the perforated panel 21, two elongate mounting straps or bars 71 are positioned horizontally across the lateral space between the rear uprights 26. Each mounting strap 71 includes semi-circular clamping portions 72 at the opposite ends thereof which curve laterally and forwardly away from an intermediate linear portion 73 thereof. Apertures 74 are included at the opposite ends of the mounting straps 71 which align with corresponding apertures 75 formed at the upper and lower corners of the perforated panel 21 so as to receive fasteners 76 therethrough. Once fastened, the upright 26 is clamped between the mounting bar 71 on a front side and the perforated panel 21 on the rear side thereof (FIG. 8A).

Figure 14:
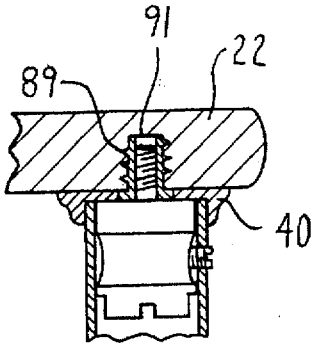
FIG. 14 is an enlarged partial sectional view of an upper connector insert of the connector assembly of FIG. 13.
Figure 17:
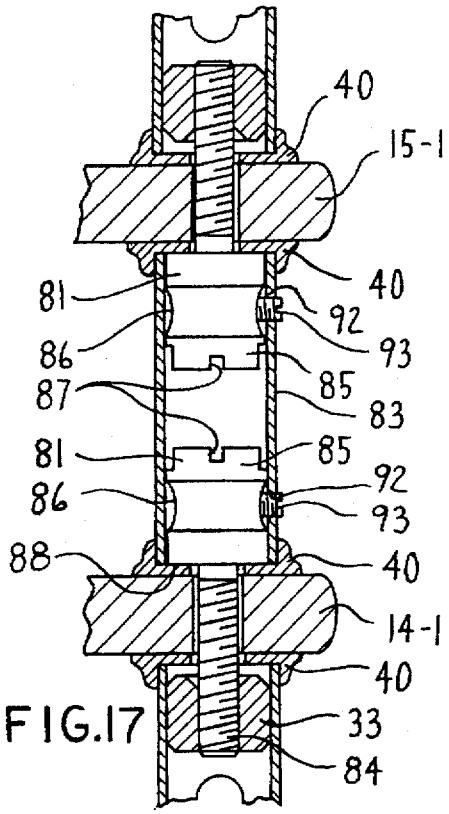
FIG. 17 is an enlarged partial sectional view of the connector assembly of FIGS. 15 and 16.
Figure 16:
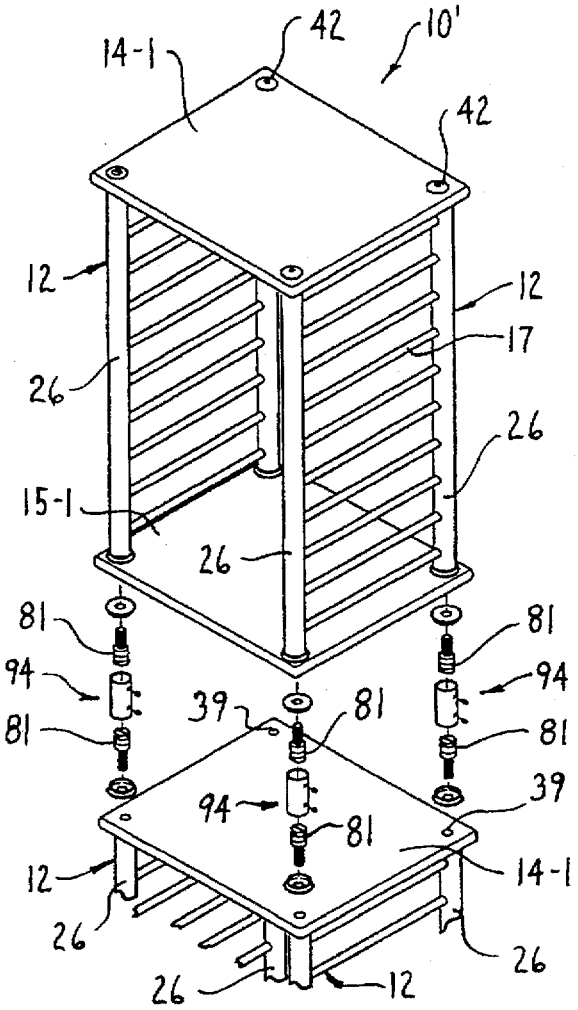
FIG. 16 is an exploded partial perspective view of the shelf unit of FIG. 15.
Figure 15:
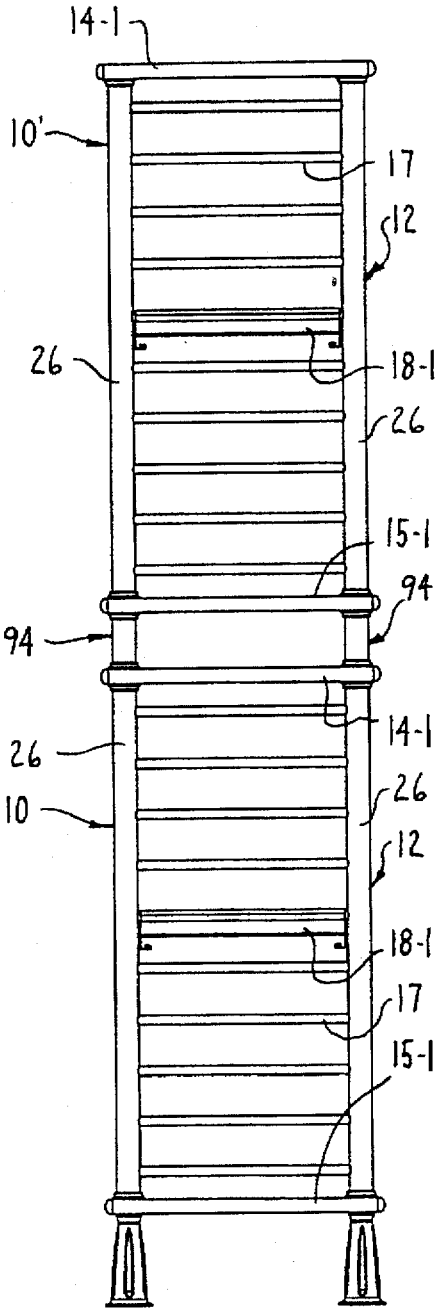
FIG. 15 is a side elevational view of a fifth embodiment of the shelf unit having a stack-on shelf unit mounted thereon.

Besides these modifications to the basic shelf unit 10, the shelf unit may also be extended upwardly, for example, by the addition of the secondary top panel 22 (FIGS. 11–14) or the additional shelf unit 10' (FIGS. 15–17).

In FIGS. 11–14, the shelf unit 10-1 includes the left and right leg structures 12 formed identical to that described above so as to include vertical uprights 26 and the ladder-like arrangement of cross members 17. However, to provide a narrower shelf unit 10-1, the top and bottom panels 14-1 and 15-1 as well as the interior shelf 18-1 have a shorter lateral length so as to be generally square. Additionally, instead of the fasteners 42, the top panel 14-1 is connected to the uprights 26 by connector assemblies 79 which also connect the secondary top panel 22 thereto.

The connector assembly 79 for the secondary top panel 22 includes a leg connector insert 81, a top connector insert 82 and a length of hollow tubular spacer 83 which is adapted to fixedly receive the leg and top connector inserts 81 and 82 in the opposite ends thereof. More particularly, the leg connector insert 81 (FIG. 13) includes a threaded shank 84 and a cylindrical head 85 having a peripheral groove 86 formed therearound and a screwdriver receiving slot 87. Securing the top panel 14-1 to the leg structures 12 is similar to that previously described whereby the shank 84 of the leg connector insert 81 is inserted through a collar 40 and into one of the top panel apertures 39 which permits threaded engagement with the upright 26. A downward facing bearing surface 88 thereby contacts the collar 40. As a result, the four corners of the top panel 14-1 are clamped in place with the head 85 projecting upwardly therefrom.

Figure 13:
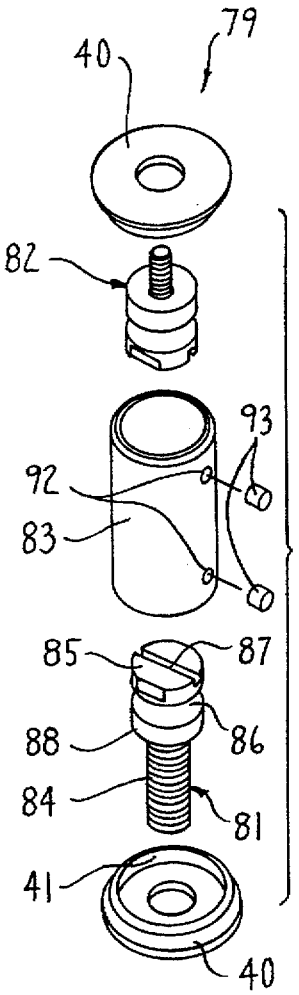
FIG. 13 is an exploded perspective view of the connector assembly of FIG. 11.
Figure 12:
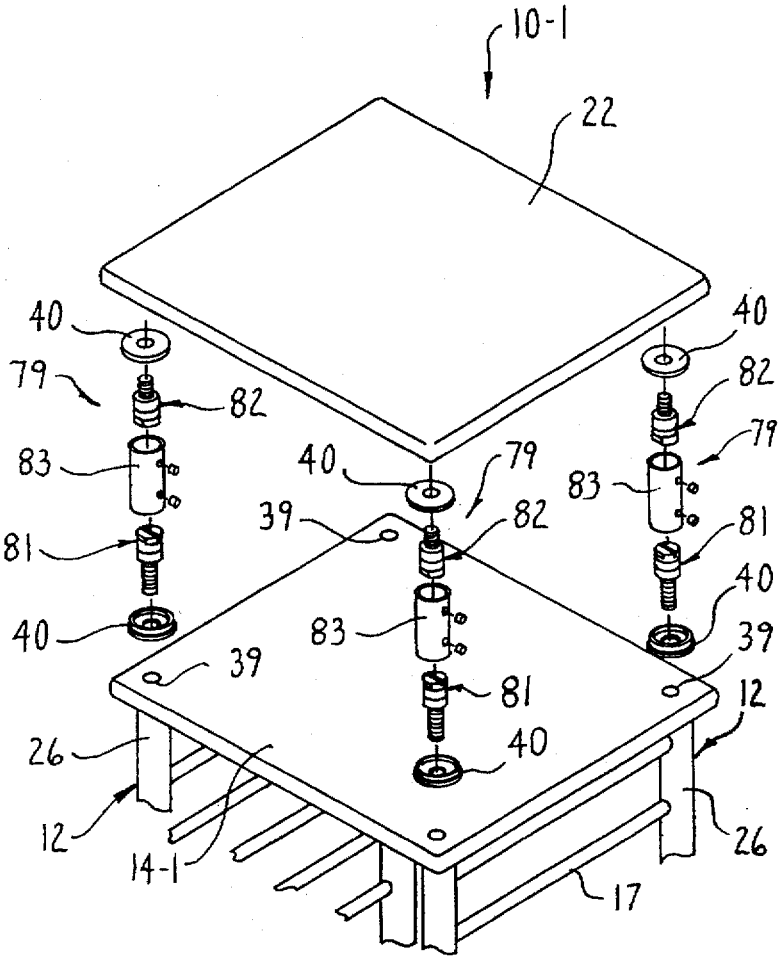
FIG. 12 is an exploded partial perspective view of the shelf unit of FIG. 11 illustrating the connection of the secondary shelf top.

In a similar manner, the top connector inserts 82 are connected to a threaded insert 89 (FIG. 14) embedded in a downward opening blind bore 91 of the secondary top panel 22 so that the head 85 projects downwardly therefrom. More particularly, the head 85 of the top connector 82 also includes a peripheral groove 86, slot 87 and bearing surface 88 while the shank 84' has a reduced diameter adapted for the insert 89. Thereafter, each leg connector insert 81 is connected to a top connector insert 82 by insertion into the opposite open ends of the spacer 83 which further includes two vertically spaced threaded apertures 92 that receive set screws 93. Referring to FIGS. 13 and 14, the set screws 83 are driven into the spacer interior so as to lockingly seat within the corresponding peripheral grooves 86 of the respective leg and top connector inserts 81 and 82 to prevent disengagement of the heads 85 therefrom. As a result, the secondary top panel 22 is mounted in place a spaced apart vertical distance from the top panel 14-1.

Using similar connector assemblies 94, a stack-on shelf unit 10' is attached to the top of the base shelf unit 10-1 in FIGS. 15–17 which stack-on shelf unit 10' is constructed as described with respect to FIGS. 1–5. In this case, however, each connector assembly 94 includes two of the leg connector inserts 81 as described above. The leg connector inserts 81 are respectively threaded into the upper end 31 of the uprights 26 that form the base shelf unit 10 and into the lower end 32' of the stack-on shelf unit 10' so as to project one towards the other. A tubular spacer 83 as described above is then seated on the heads 85 of the opposing connector inserts 81 and secured thereto by driving of the set screws 93 (FIG. 17). In this manner, the stack-on shelf unit 10' is joined to the base shelf unit 10.

In view of the teachings herein, it is also possible to reconfigure the shelf units illustrated in FIGS. 1–17 so as to provide variations thereof. For example, the embodiment of FIG. 16 can further include a secondary top panel 22 mounted thereon, still further, the components such as the fixed legs 19, caster assemblies 20, interior shelves 18 and 18', the perforated panel 20 and other components can be readily provided or rearranged to vary the configuration of a shelf unit.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An upright free-standing shelf unit comprising:

a pair of laterally spaced apart upstanding leg structures which are disposed proximate the opposite ends of the shelf unit and define an open area therebetween, each of said leg structures including parallel front and rear uprights connected one with the other by a vertically spaced arrangement of cross rods which extend transversely between said front and rear uprights and are connected at their opposite front and rear ends to the uprights, said cross rods and said uprights being rigidly fixed together so that each of said leg structures is ladder-shaped, upper and lower ends of each said upright including connector engagement means which is accessible from an exterior of said uprights;

at least one horizontal shelf extending laterally between said leg structures within said open area and having support means at opposite ends thereof for removably engaging a selected one of said cross rods of each said leg structure to support said shelf at a selected height between said upper and lower ends of said leg structures;

upper and lower horizontally enlarged panels connected respectively to said upper and lower ends of said uprights and defining upward facing surfaces, said shelf being disposed between said upper and lower panels;

a plurality of connectors having a first end and an elongate member which projects away from said first end and extends through said respective upper and lower panels into fixed engagement with said engagement means at said respective upper and lower ends of said uprights, said first end of each said connector defining a bearing surface which faces towards said upright and clamps said respective upper and lower panels between said bearing surface and said respective upper and lower ends of said corresponding upright.

2. A shelf unit according to claim 1, wherein each of said upper and lower panels includes at least four bores which open vertically therethrough, each of said bores being respectively aligned with said engagement means of a respective one of said upper and lower ends of said uprights, said elongate member of said connector defining a second end opposite said first end, said second end being insertable through said respective bore toward said respective end of said upright for engagement with said engagement means thereof.

3. A shelf unit according to claim 2, wherein said second end of each of said connectors which connect said lower panel to said lower ends of said uprights is insertable from below through said respective bore of said lower panel, said first end of each of said lower connectors being one of a caster assembly and a fixed support leg which projects downwardly and includes said bearing surface.

4. A shelf unit according to claim 3, wherein said engagement means at each of the upper and lower ends of said uprights comprise an annular insert secured thereto, each said annular insert having a bore which opens vertically and engages a respective one of said elongate members of said connectors therein.

5. A shelf unit according to claim 1, wherein said engagement means of each of said upper and lower ends of said uprights is engagable with said connectors for either of said upper and lower panels, said leg structures being formed identical so as to be reversible.

6. A shelf unit according to claim 1, wherein said shelf is removably engaged with said cross rods to adjust said height.

7. An upright free-standing shelf unit comprising:

a first pair of laterally spaced apart upstanding leg structures, each of said leg structures including front and rear parallel uprights which include upper and lower ends, each said upper end including connector engagement means accessible from an exterior of said upright for securing said leg structures in position;

upper and lower horizontally enlarged panels connected respectively to said upper and lower ends of said uprights and defining upward facing surfaces;

a plurality of first connectors which are connectable to said respective connector engagement means of said uprights for joining said upper panel to said upper ends of said uprights, each said first connector having a connector insert and an elongate member which projects from said connector insert, said elongate member being insertable downwardly through said upper panel and being engaged with said connector engagement means of said respective upright such that said connector insert projects upwardly from said upper panel, said connector insert defining a bearing surface which faces towards said upward facing surface of said upper panel so as to clamp said upper panel between said bearing surface and said upper end of said corresponding upright; and a horizontally enlarged third panel which is spaced upwardly from said upper panel, said third panel including a plurality of second connectors each having a connector insert projecting downwardly from a downward facing surface of said third panel, said third panel being connected to said upper panel in vertically spaced relation by a plurality of elongate spacers, each said spacer having hollow lower and upper ends which open vertically and respectively receive said connector inserts of said first and second connectors therein, each of said connector inserts of said first and second connectors including a recess in an outer periphery thereof, each of said lower and upper ends of each said spacer including spacer engagement means for securing said spacer to said respective connector insert so that said spacer is respectively engaged with said first and second connectors to mount said third panel to said upper panel, said spacer engagement means being lockingly engaged with a respective one of said upper and lower ends once said respective connector insert is received within said spacer, said spacer engagement means being an engagement member which projects inwardly through a wall of said spacer into a hollow interior thereof, said engagement member being movably engaged with said wall so as to be movable inwardly into engagement with said recess to secure said spacer to said respective connector insert.

8. A shelf unit according to claim 7, wherein said engagement member is a set screw threadingly engaged through said wall of said spacer.

9. A shelf unit according to claim 2, wherein said recess is an annular peripheral groove extending about said outer periphery.

10. A shelf unit according to claim 7, wherein said second connectors are formed the same as the first connectors so as to include said elongate member projecting from said connector insert, said third panel being connected to a second pair of said leg structures which extend upwardly therefrom and said elongate members of said second connectors being inserted upwardly through said third panel and engaged with respective engagement means disposed in said lower ends of said second pair of leg structures.

11. A shelf unit according to claim 10, wherein each of said leg structures of said first and second pairs includes a vertically spaced plurality of cross members which are connected at opposite ends thereof to said respective front and rear uprights, at least one horizontal shelf extending laterally between a respective one of said first and second pairs of said leg structures, said shelf having support means at opposite ends thereof for engaging a selected one of said cross members of each said leg structure to support said shelf at a selected height between said upper and lower ends of said respective leg structures.

12. A shelf unit according to claim 7, wherein said recess is an annular peripheral groove extending about said outer periphery.

* * * * *

UNITED STATES PATENT AND TRADEMARK OFFICE

CERTIFICATE OF CORRECTION

PATENT NO. : 5 706 741

DATED : January 13, 1998

INVENTOR(S) : Clarkson S. Thorp et al

It is certified that error appears in the above-indentified patent and that said Letters Patent is hereby corrected as shown below:

Column 8, line 38; change "claim 2," to
---claim 8,---.

Signed and Sealed this

Twenty-eighth Day of July, 1998

*Attest:*

Bruce Lehman

BRUCE LEHMAN

*Attesting Officer*

*Commissioner of Patents and Trademarks*